US012410552B2

(12) United States Patent
Bellinger et al.

(10) Patent No.: US 12,410,552 B2
(45) Date of Patent: Sep. 9, 2025

(54) THREE-DIMENSIONAL STEAM GENERATING SYSTEM FOR PERFORMING A STEAM CYCLE WITHIN A LAUNDRY APPLIANCE

(71) Applicant: WHIRLPOOL CORPORATION, Benton Harbor, MI (US)

(72) Inventors: Ryan R. Bellinger, St. Joseph, MI (US); Shannon Wynne, Holland, MI (US); Mark J. Christensen, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 771 days.

(21) Appl. No.: 17/709,951

(22) Filed: Mar. 31, 2022

(65) Prior Publication Data

US 2022/0364295 A1 Nov. 17, 2022

Related U.S. Application Data

(60) Provisional application No. 63/189,289, filed on May 17, 2021.

(51) Int. Cl.

| | |
|---|---|
| ***D06F 58/44*** | (2020.01) |
| ***D06F 34/18*** | (2020.01) |
| ***D06F 34/26*** | (2020.01) |
| ***D06F 39/40*** | (2024.01) |
| ***D06F 58/02*** | (2006.01) |
| ***D06F 58/20*** | (2006.01) |

(Continued)

(52) U.S. Cl.

CPC ..... *D06F 58/44* (2020.02); *D06F 34/18* (2020.02); *D06F 34/26* (2020.02); *D06F 39/40* (2024.01); *D06F 58/02* (2013.01); *D06F 58/203* (2013.01); *D06F 2103/32* (2020.02); *D06F 2103/34* (2020.02); *D06F 2105/40* (2020.02)

(58) Field of Classification Search

CPC ..... D06F 58/44; D06F 34/18; D06F 34/26; D06F 39/40; D06F 58/02; D06F 58/203; D06F 2103/32; D06F 2103/34; D06F 2105/40; D06F 2103/04; D06F 2103/06; D06F 2103/08; D06F 2103/12

USPC ..... 34/130

See application file for complete search history.

(56) References Cited

U.S. PATENT DOCUMENTS

| | | | |
|---|---|---|---|
| 8,522,451 | B2 | 9/2013 | Chernetski et al. |
| 9,027,368 | B2 | 5/2015 | Ji et al. |

(Continued)

FOREIGN PATENT DOCUMENTS

| | | |
|---|---|---|
| CN | 106319865 A | 1/2017 |
| CN | 208907180 | 5/2019 |

(Continued)

*Primary Examiner* — John P McCormack

(74) *Attorney, Agent, or Firm* — Price Heneveld LLP

(57) ABSTRACT

A laundry appliance includes a blower that delivers process air through an airflow path. A rotating drum defines a processing chamber. The processing chamber is part of the airflow path. A steam generating system disposes steam into the processing chamber. A plurality of fluid nozzles direct the steam into the processing chamber according to an operating pattern. The plurality of fluid nozzles include a first nozzle that is positioned within an upper portion of the processing chamber and a second nozzle that is positioned in a lower portion of the processing chamber.

20 Claims, 14 Drawing Sheets

(51) Int. Cl.

| | |
|---|---|
| *D06F 103/32* | (2020.01) |
| *D06F 103/34* | (2020.01) |
| *D06F 105/40* | (2020.01) |

(56) References Cited

U.S. PATENT DOCUMENTS

| | | | | |
|---|---|---|---|---|
| 9,322,127 | B2 | 4/2016 | Ashrafzadeh et al. | |
| 9,663,894 | B2 | 5/2017 | Kim et al. | |
| 2008/0040869 | A1 | 2/2008 | Wong et al. | |
| 2010/0050464 | A1 | 3/2010 | Krzelowski et al. | |
| 2010/0115788 | A1* | 5/2010 | Kim | D06F 58/203 34/443 |
| 2011/0138542 | A1* | 6/2011 | Ji | D06F 33/65 8/137 |
| 2011/0153086 | A1* | 6/2011 | Bellinger | D06F 58/36 700/275 |
| 2011/0154678 | A1 | 6/2011 | Lee | |
| 2011/0246602 | A1* | 10/2011 | Mihara | H04N 1/00464 709/217 |
| 2014/0350728 | A1* | 11/2014 | Ashrafzadeh | D06F 58/48 700/275 |
| 2018/0105969 | A1* | 4/2018 | Civanelli | F25B 13/00 |
| 2019/0323161 | A1* | 10/2019 | Im | D06F 37/04 |
| 2020/0208326 | A1 | 7/2020 | Hong et al. | |

FOREIGN PATENT DOCUMENTS

| | | | |
|---|---|---|---|
| EP | 2821540 | | 10/2020 |
| KR | 100740836 | | 7/2007 |
| KR | 20100081205 | A | 7/2010 |
| KR | 20130065207 | A | 6/2013 |
| WO | 2012086345 | | 6/2012 |
| WO | 2020019933 | | 1/2020 |

* cited by examiner

THREE-DIMENSIONAL STEAM GENERATING SYSTEM FOR PERFORMING A STEAM CYCLE WITHIN A LAUNDRY APPLIANCE

CROSS-REFERENCE TO RELATED APPLICATION

This application claims priority to and the benefit under 35 U.S.C. § 119(e) of U.S. Provisional Patent Application No. 63/189,289, filed on May 17, 2021, entitled THREE-DIMENSIONAL STEAM GENERATING SYSTEM FOR PERFORMING A STEAM CYCLE, the entire disclosure of which is hereby incorporated herein by reference.

FIELD OF THE DEVICE

The device is generally in the field of laundry appliances, and more specifically, a laundry appliance including a plurality of fluid-directing nozzles that are operable to perform a variety of steam functions that can be adjusted based upon various parameters.

SUMMARY OF THE DEVICE

According to one aspect of the present disclosure, a laundry appliance includes a blower that delivers process air through an airflow path. A rotating drum defines a processing chamber. The processing chamber is part of the airflow path. A steam generating system disposes steam into the processing chamber. A plurality of fluid nozzles direct the steam into the processing chamber according to an operating pattern. The plurality of fluid nozzles include a first nozzle that is positioned within an upper portion of the processing chamber and a second nozzle that is positioned in a lower portion of the processing chamber.

According to another aspect of the present disclosure, a laundry appliance includes a cabinet having an access aperture defined within a front panel of the cabinet. A drum rotates within the cabinet. The access aperture provides selective access to a processing chamber defined within the drum. A steam generating system delivers steam to the processing chamber. A first nozzle is coupled to the front panel and above the access aperture. A second nozzle is positioned within a rear panel of the processing chamber. A steam generator delivers steam to the first nozzle and the second nozzle according to an operating pattern. The operating pattern is determined by a plurality of sensors that are positioned in communication with the processing chamber. The steam generator generates steam in the absence of a dedicated heating element.

According to yet another aspect of the present disclosure, a laundry appliance includes a cabinet having an access aperture. A drum rotates within the cabinet to process a load of articles. The access aperture provides selective access to a processing chamber defined within the drum. A steam generating system delivers steam to the processing chamber. A first nozzle is coupled to a front panel and above the access aperture. A second nozzle is positioned within a rear panel of the processing chamber. The steam generating system delivers steam to the first nozzle and the second nozzle according to an operating pattern. The operating pattern is determined by a plurality of sensors that are positioned in communication with the processing chamber. The first nozzle is oriented to direct a first jet of fluid in a downward direction toward a rear panel of the processing chamber and the second nozzle is positioned within the rear panel and is oriented to direct a second jet of fluid in an upward direction toward the access aperture. The first and second jets of fluid define a three-dimensional pattern of steam that engages the load of articles from above and below, respectively.

These and other features, advantages, and objects of the present disclosure will be further understood and appreciated by those skilled in the art by reference to the following specification, claims, and appended drawings.

Figure 1:
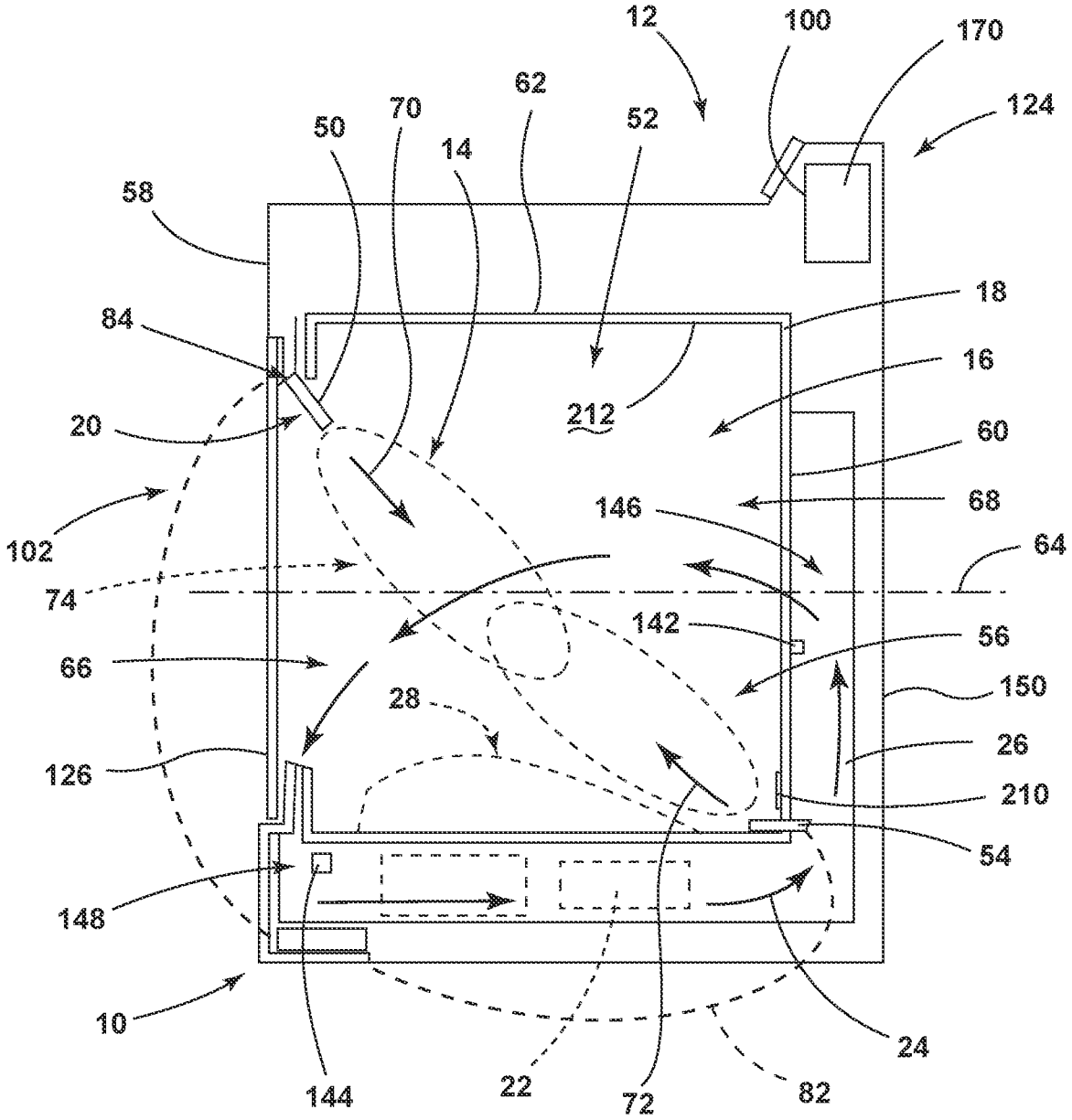
FIG. 1 is a schematic cross-sectional view of a laundry appliance that incorporates an aspect of the steam generating system.
Figure 2:
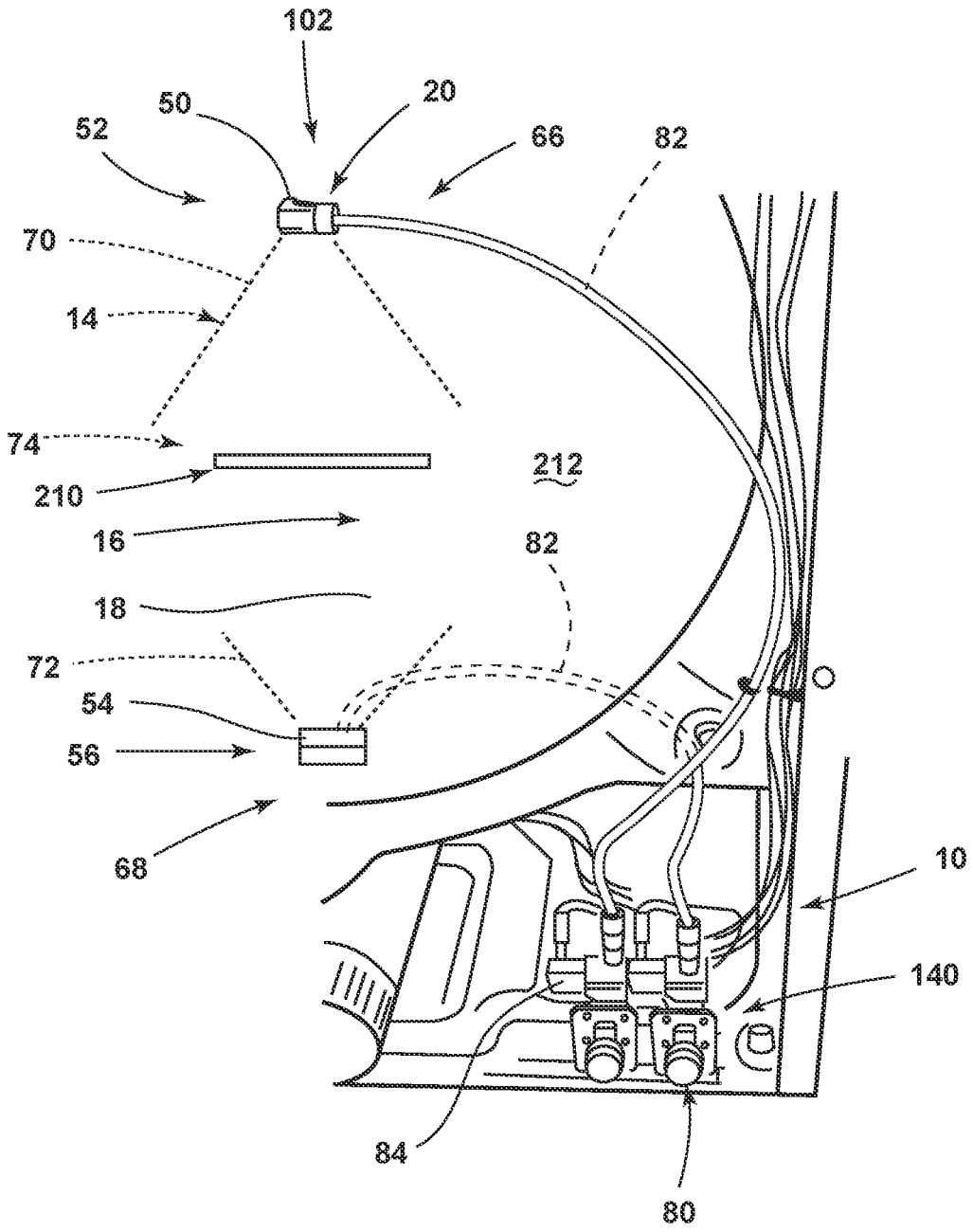
FIG. 2 is a schematic perspective view of a steam generating system for a laundry appliance.

The components in the figures are not necessarily to scale, emphasis instead being placed upon illustrating the principles described herein.

DETAILED DESCRIPTION

The present illustrated embodiments reside primarily in combinations of method steps and apparatus components related to a team generating system for a laundry appliance that operates according to a sequence that is adjustable based upon various parameters. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-8, reference numeral 10 generally refers to a steam generating system for a laundry appliance 12 that generates steam 14 within a processing chamber 16 of the appliance 12, typically within a rotating drum 18. A steam generating system 10 includes a plurality of fluid nozzles 20 that are used to generate steam 14 within the processing chamber 16. According to various aspects of the device, the appliance 12 includes a blower 22 that delivers process air 24 through an airflow path 26. The rotating drum 18 defines the processing chamber 16. The processing chamber 16 is included within the airflow path 26 for receiving process air 24 that dehumidifies articles 28 contained within the processing chamber 16. The steam generating system 10 operates to dispose steam 14 within the processing chamber 16. The plurality of fluid nozzles 20 operate to direct the steam 14 into and through the processing chamber 16 according to a predetermined operating pattern 30. According to various aspects of the device, the predetermined operating pattern 30 can be based upon various factors. These factors can include, but are not limited to, the type of article 28 or fabric that is being processed within the processing chamber 16, an amount of articles 28 that are being processed within the processing chamber 16, combinations thereof and other factors.

Typically, the predetermined operating pattern 30 can vary depending upon various parameters relating to the selected operating cycle 32 and the articles 28 being processed within the processing chamber 16. These predetermined operating patterns 30 typically include selective operation of the steam generating system 10. This selective operation is in the form of activations 34 and deactivations 36 of the plurality of fluid nozzles 20. These activations 34 and deactivations 36 can be sequential, alternating, combinations thereof and other operating patterns 30 of activations 34 and deactivations 36 of one or more of the plurality of fluid nozzles 20. The activations 34 and deactivations 36 of the operating pattern 30 can be modified or adjusted based upon the measurements taken by one or more sensors, and typically a plurality of sensors. The sensors are configured to take measurement of the process air 24, the conditions within the processing chamber 16 and the conditions of the articles 28 being processed. Using these measurements, the controller 170 can assess whether any of the activations 34 or the deactivations 36 of the operating pattern 30 need to be extended, suspended or otherwise modified.

According to various aspects of the device, the steam generating system 10 includes a steam generator that generates steam 14 within the processing chamber 16 without the use of a dedicated heat source within the steam generating system 10. Accordingly, the steam generating system 10 generates steam 14 having a temperature that is similar to that of the air temperature of the process air 24 within the processing chamber 16. In this manner, fluid 82 is delivered to the fluid nozzles 20 and is sprayed into the processing chamber 16 in the form of a fine mist. Various differences in humidity levels, dew points, and other environmental factors between areas outside of the processing chamber 16 and the areas inside of the processing chamber 16 cooperate to generate steam 14 within the processing chamber 16. Various air handlers can be used to move the steam 14 that is generated within the processing chamber 16 around and through the articles 28 to be processed in the laundry appliance 12.

Referring now to FIGS. 1-6, the plurality of fluid nozzles 20 can include a front fluid nozzle 50, also referred to herein as the first nozzle, that is positioned to generate steam 14 within an upper portion 52 of the processing chamber 16, and a rear fluid nozzle 54 that is positioned to generate steam 14 within a lower portion 56 of a processing chamber 16. The front fluid nozzle 50 can be positioned near or within a front panel 58 of the appliance 12 so that the fluid nozzle 20 is directed to inject or otherwise dispose a first jet 70 of fluid 82 in a generally downward direction into the access aperture 122 and toward a rear panel 60 of the rotating drum 18. The rear fluid nozzle 54, also referred to herein as the second nozzle, is typically positioned within the rear panel 60 for the rotating drum 18 that is generally stationary as a perimetrical wall 62 of the rotating drum 18 rotates about a rotational axis 64. The rear fluid nozzle 54 is adapted to direct a second jet 72 of fluid 82 in a generally upward direction and toward the access aperture 122. When both the front and rear fluid nozzles 50, 54 are activated, steam 14 is generated within a front portion 66 and the upper portion 52 of the processing chamber 16 and a rear portion 68 and the lower portion 56 of the processing chamber 16. In this manner, the steam 14 generated by a plurality of fluid nozzles 20 can be moved throughout the entire processing chamber 16 for penetrating within, around and through the articles 28 being processed within the rotating drum 18. This configuration of the steam generating system 10 also allows the articles 28 to tumble through areas of steam 14 that are generated in the processing chamber 16.

Referring again to FIGS. 1 and 2, the steam generating system 10 includes a fluid delivery manifold 80 that directs a fluid 82 to the front and rear fluid nozzles 50, 54. Various valves 84 are attached to the fluid delivery manifold 80 and/or the front and rear fluid nozzles 50, 54 for selectively operating the front and rear fluid nozzles 50, 54 (first and second nozzles). This selective operation of the front and rear fluid nozzles 50, 54 is used to perform the various activations 34 and deactivations 36 of the steam generating system 10 and the plurality of fluid nozzles 20. The front and rear fluid nozzles 50, 54 of the steam generating system 10 operate to define a three-dimensional pattern 74 of steam 14 that engages the articles 28 within the processing chamber 16 from the front and from the rear as well as from above and below, as described more fully herein.

Figure 3:
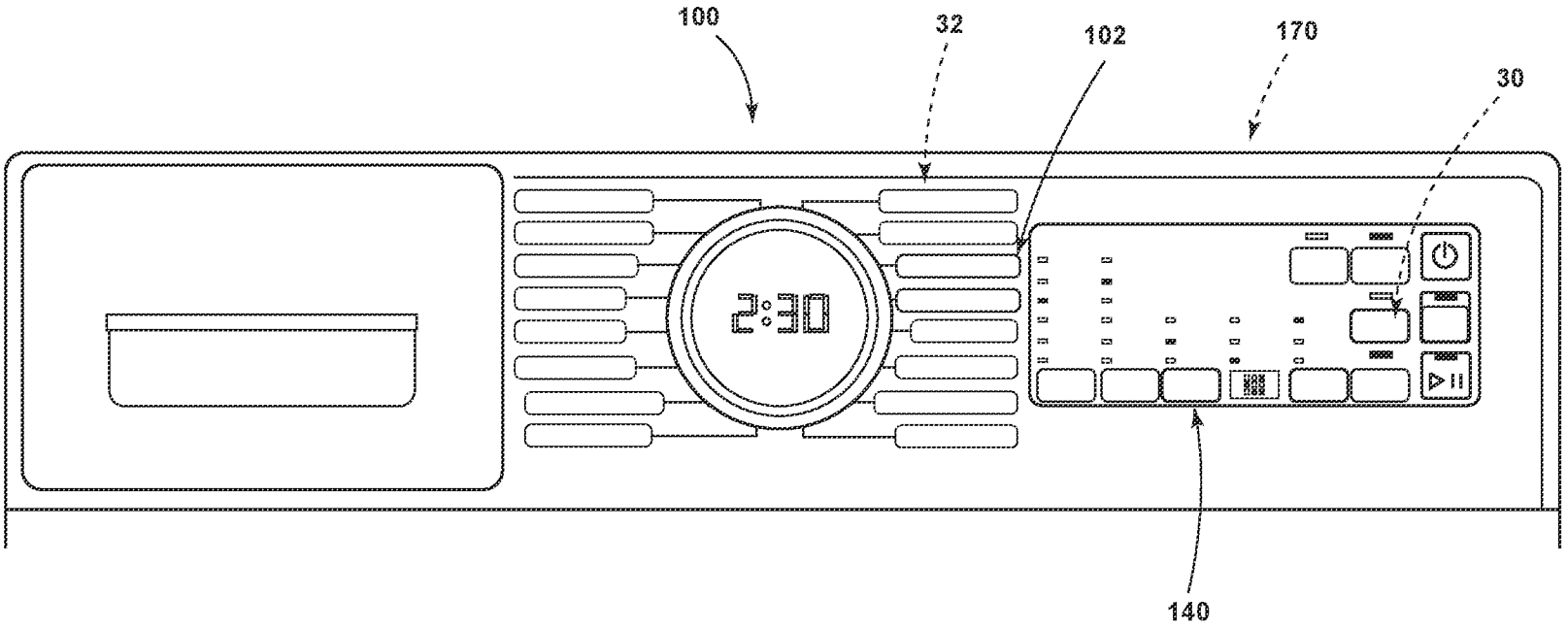
FIG. 3 is an elevational view of an aspect of a user interface that is incorporated within a laundry appliance for operating a steam cycle.

Referring now to FIG. 3, a user interface 100 for the appliance 12 can include dedicated controls for operating the steam generating system 10 during performance of any one or more operating cycles 32 of the appliance 12. Certain operating cycles 32 can include a built-in steam function 102 that automatically operates within a portion of the operating cycle 32. It is also contemplated that various steam functions 102 can be specifically selected utilizing the user interface 100. These specific selections can activate or deactivate a steam function 102, increase or decrease the amount of steam 14 generated during a processing chamber 16, set various parameters regarding the amount of steam 14 to be generated, and other similar factors that are described more fully herein.

Figure 4:
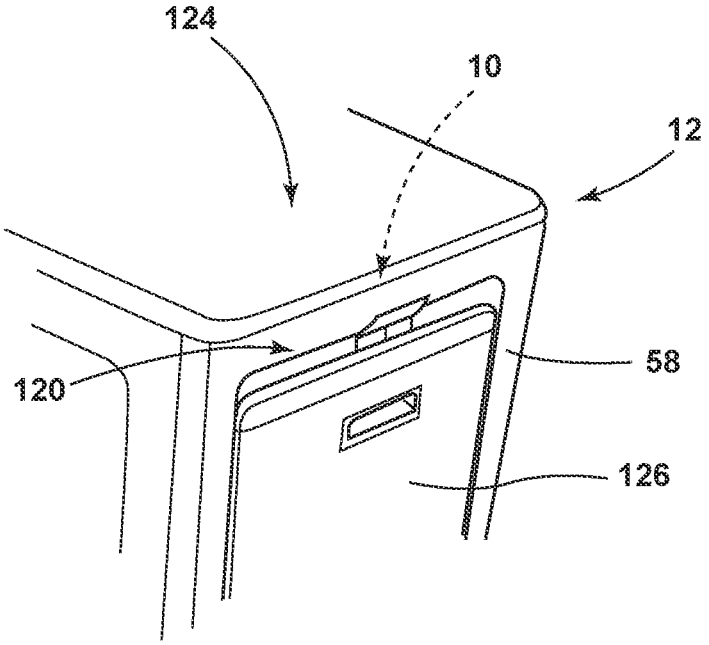
FIG. 4 is a front perspective view of a laundry appliance that incorporates an aspect of a steam generating system.
Figure 5:
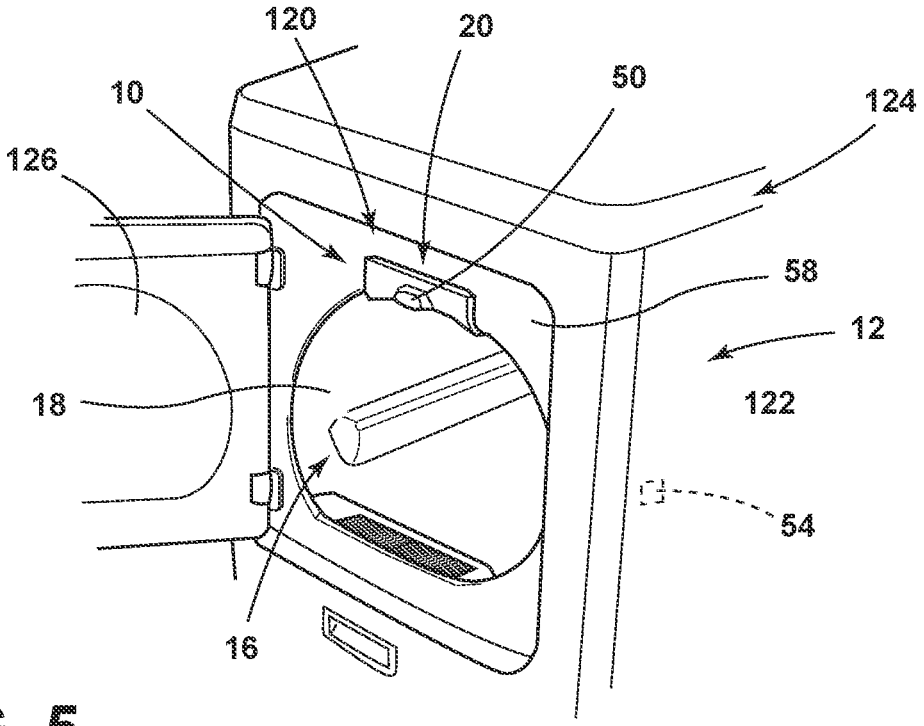
FIG. 5 is a perspective view of the laundry appliance of FIG. 4 showing a door in the open position and a position of one of the fluid nozzles of a plurality of fluid nozzles for the steam generating system.
Figure 6:
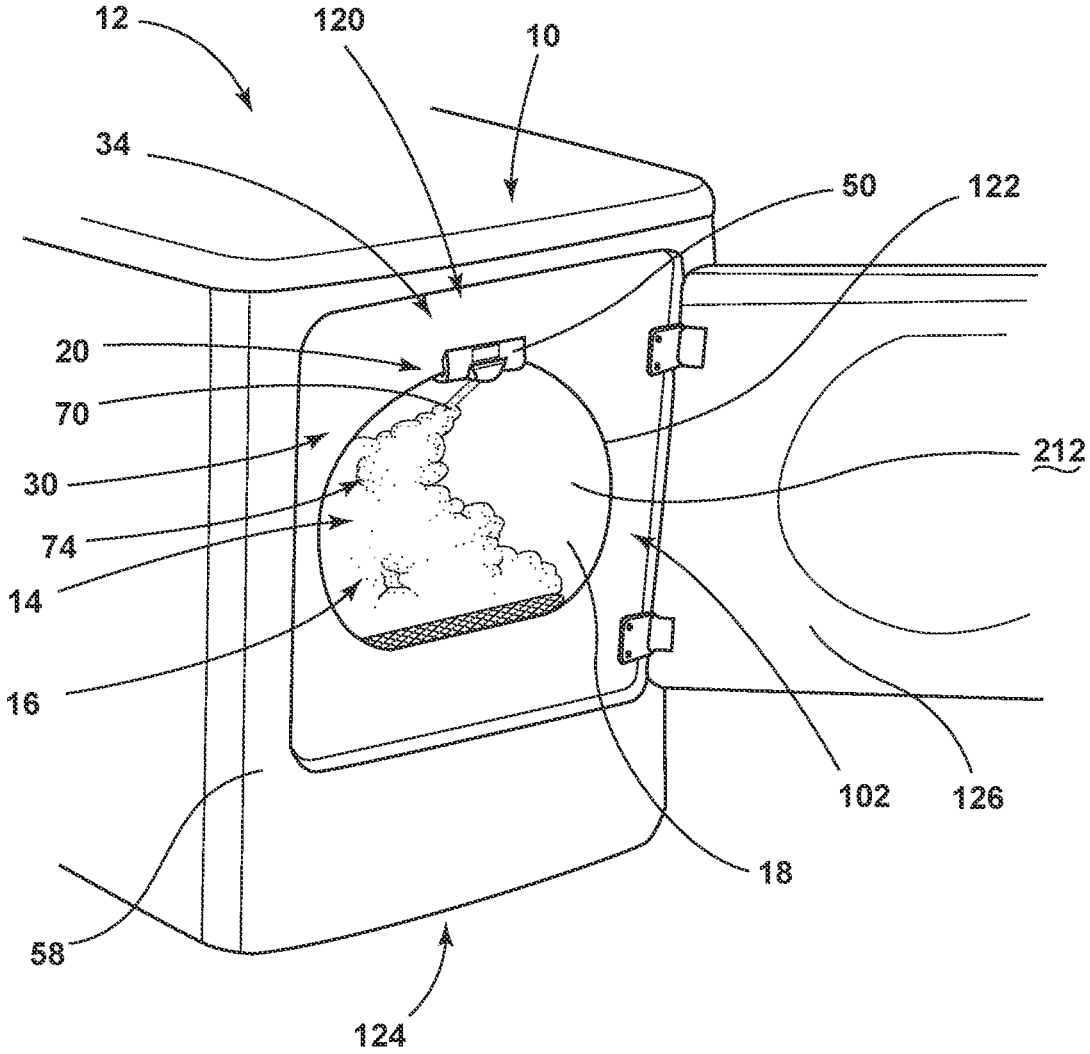
FIG. 6 is a front perspective view of a laundry appliance showing steam being generated within the processing chamber.

Referring now to FIGS. 4-6, the front fluid nozzle 50 is typically positioned at a 12-o'clock position of a rotating drum 18 and near a top portion 120 of the access aperture 122 of the rotating drum 18. The front fluid nozzle 50 may be attached to the outer cabinet 124 or attached to a structural member of the appliance 12 near the outer cabinet 124. In this manner, the front fluid nozzle 50 is stationary as the drum 18 rotates about the rotational axis 64. The front fluid nozzle 50 directs the fluid 82 through the access aperture 122 and into the processing chamber 16 so that steam 14 can be generated within the processing chamber 16. In various aspects of the device, the door panel 126 for the appliance 12 can include a window so that a user can view the generation of steam 14 within the processing chamber 16.

Figure 7:
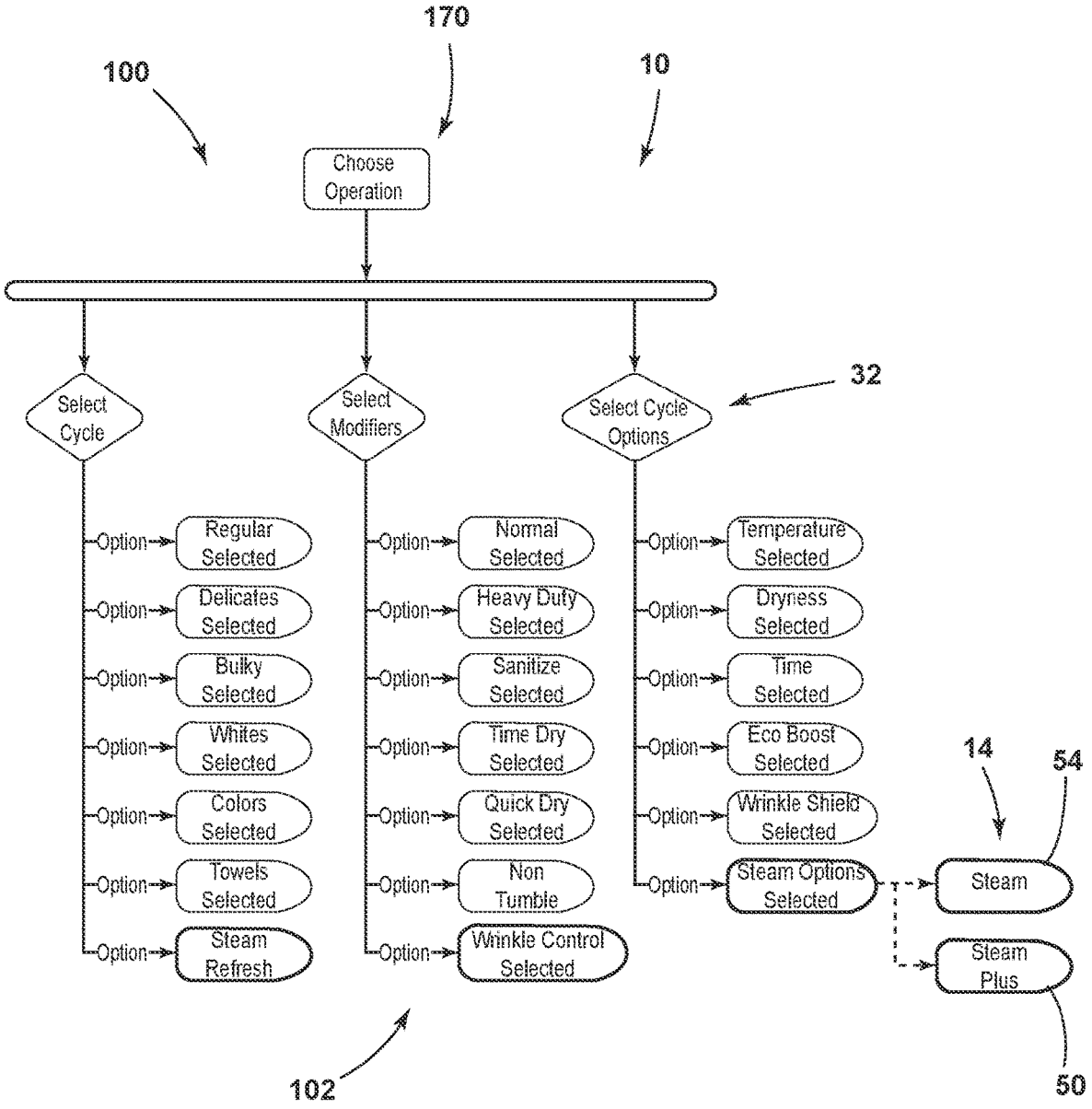
FIG. 7 is a schematic flow diagram illustrating an aspect of the selection program for a user interface for initiating a steam function of a laundry appliance.
Figure 8:
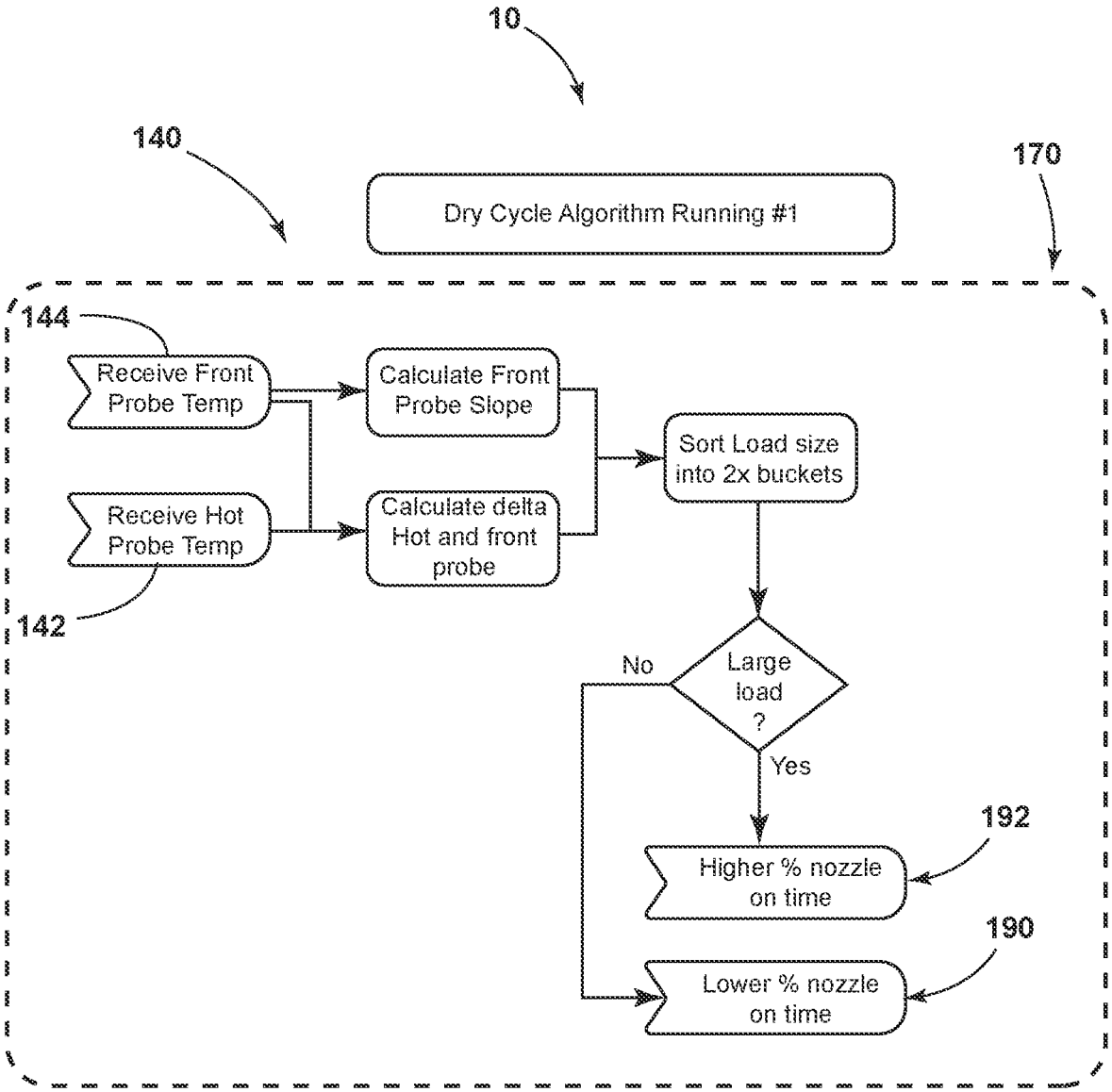
FIG. 8 is a schematic flow diagram illustrating an algorithm for estimating a size of a load being processed within a laundry appliance.
Figure 9:
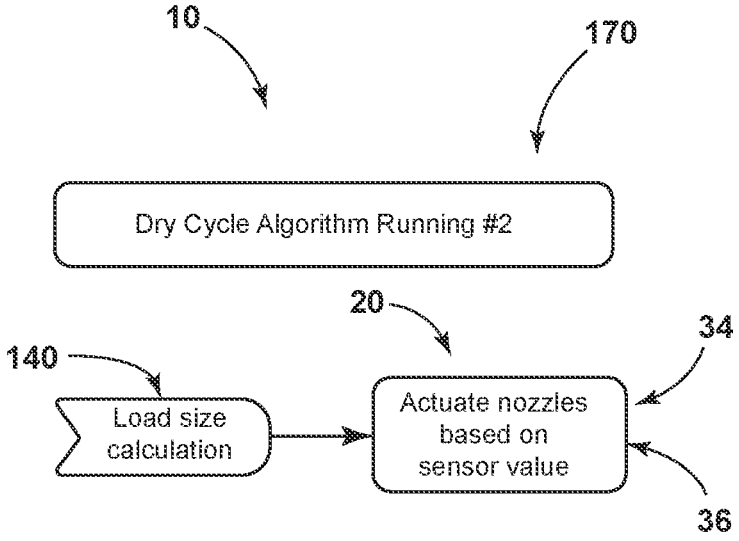
FIG. 9 is a schematic flow diagram illustrating a process for calculating load size and activating a steam function for a laundry appliance.

Referring now to FIGS. 7-9, the steam generating system 10 can include an automatic activation sequence 140 that can be used to determine the appropriate amount of steam 14 to be generated within the processing chamber 16. While various sensors and data points can be utilized for estimating the amount of articles 28 being processed or the type of articles 28 being processed, an exemplary aspect of the device includes rear and front temperature probes 142, 144 that are positioned at an upstream location 146 of the processing chamber 16 and a downstream location 148 of the processing chamber 16, respectively. As exemplified in FIG. 1, the front temperature probe 144 is positioned at the downstream location 148 so that process air 24 leaving the processing chamber 16 can be monitored by the front temperature probe 144 for determining temperature of the process air 24 leaving the processing chamber 16. The rear temperature probe 142 monitors the temperature of the process air 24 entering into the processing chamber 16, and is typically positioned behind the rotating drum 18 within a portion of the airflow path 26 proximate a back wall 150 of the appliance 12.

The rear and front temperature probes 142, 144 monitor a change or "A" of the temperature for the process air 24 as it moves through the processing chamber 16 and engages the various articles 28 to dehumidify the articles 28 during the laundry cycle. The change in temperature, or the temperature difference, of the process air 24 can have a predictable temperature change depending upon the amount of articles 28 being processed within the processing chamber 16. Utilizing this temperature difference between the temperature of the process air 24 entering the processing chamber 16 and the temperature of the process air 24 leaving the processing chamber 16, the amount of articles 28 being processed can be estimated and categorized between a small load, medium load and large load. It is also contemplated that the load sizes can be sorted into fewer categories, such as large load and small load. Greater numbers of categories can also be used depending upon the sensitivity of the rear and front temperature probes 142, 144 and the desired accuracy of the various steam functions 102.

Referring again to FIGS. 8 and 9, when the size of the load is estimated, the amount of steam 14 to be generated within the processing chamber 16 can be increased for larger loads and decreased for smaller loads. The amount of steam 14 to be generated is intended to be an appropriate amount for refreshing or de-wrinkling clothing without causing an undesirable accumulation of moisture within the processing chamber 16 that may cause the articles 28 to become over saturated with fluid 82.

As exemplified in FIGS. 8 and 9, the amount of moisture to be generated within the processing chamber 16 is a value that can be calculated by a controller 170 for the appliance 12. The performance of generating steam 14 within the processing chamber 16 is undertaken by the various activations 34 and deactivations 36 of the front and rear fluid nozzles 50, 54. By way of example, and not limitation, a greater amount of steam 14 that is to be generated within the processing chamber 16 can result in a greater amount of activations 34 or longer periods of activation 34 between the front and rear fluid nozzles 50, 54. Where lesser amounts of steam 14 are intended to be generated, there may be a greater degree of deactivations 36 or longer period of deactivation 36 between the front and rear fluid nozzles 50, 54 for the steam generating systems 10. Stated another way, more activations 34 and/or longer activations 34 generally result in a greater amount of steam 14 that is generated within the processing chamber 16.

Figure 10:
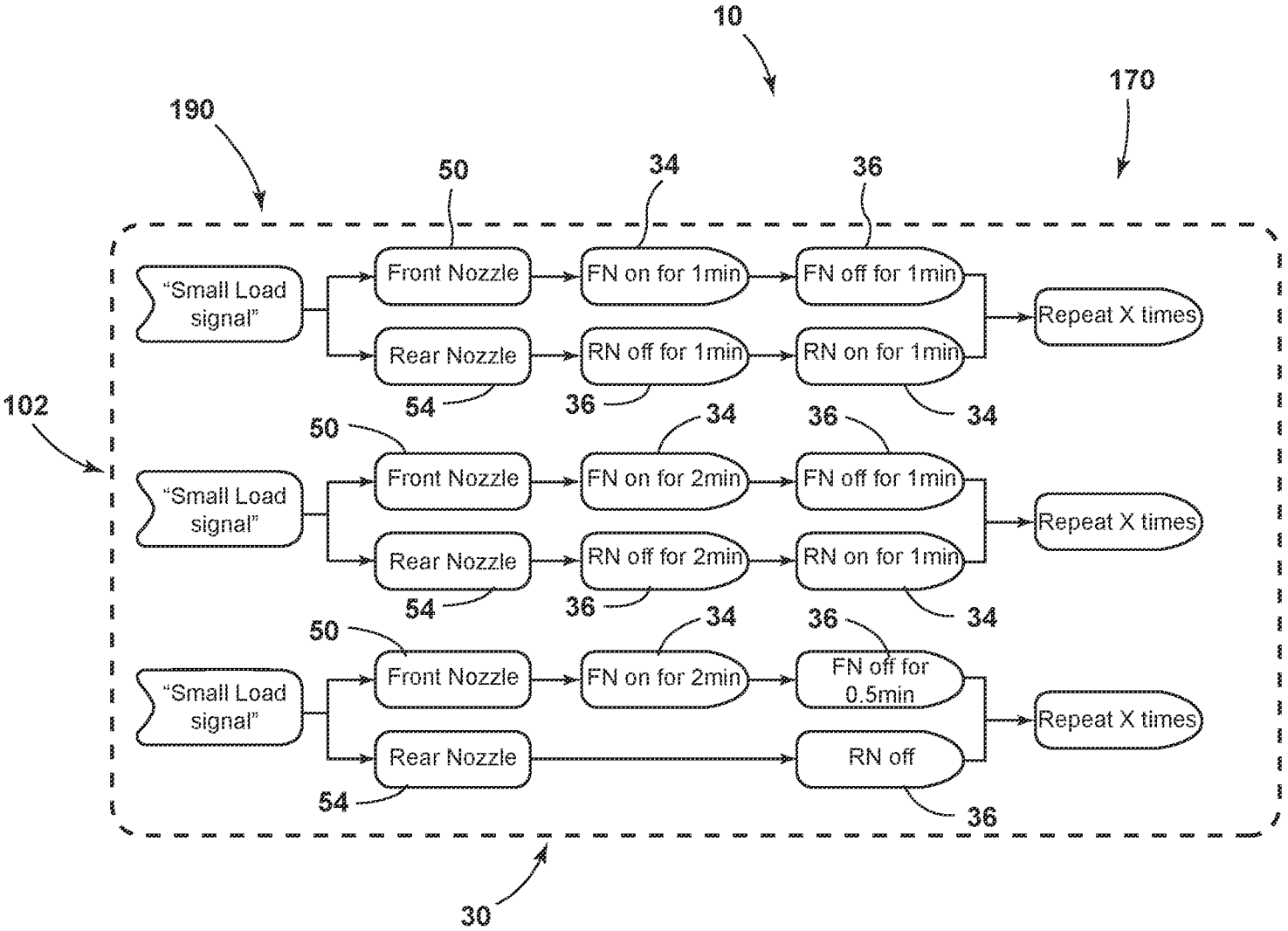
FIG. 10 is a schematic flow diagram illustrating a plurality of steam sequences that are operated based upon a size of a load being processed within the appliance.
Figure 11:
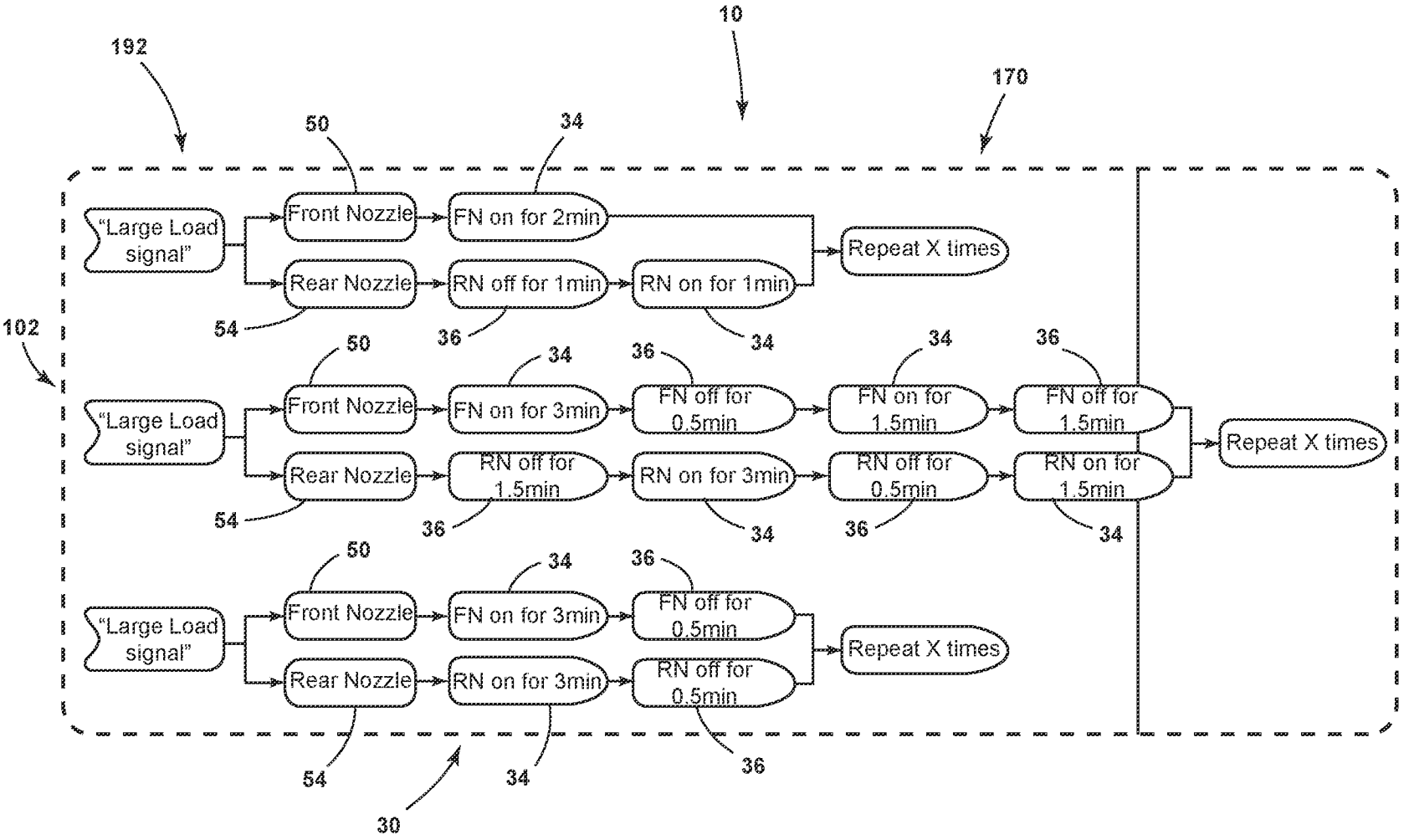
FIG. 11 is a schematic flow diagram illustrating a plurality of steam sequences that are operated based upon a size of a load being processed within the appliance.
Figure 12:
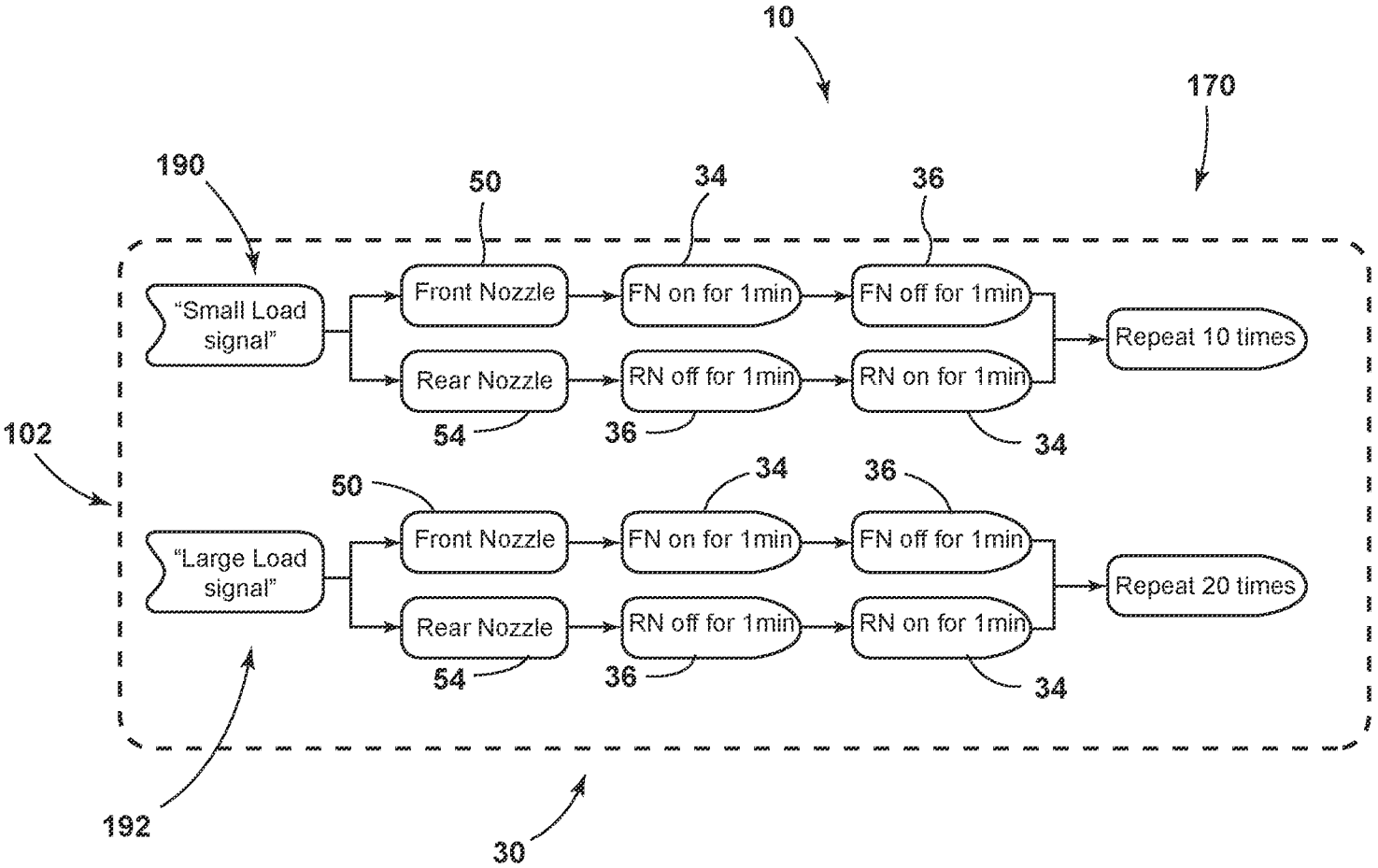
FIG. 12 is a schematic flow diagram illustrating a plurality of steam sequences that are operated based upon a size of a load being processed within the appliance.

Referring now to FIGS. 10-12, depending upon the amount of articles 28 that are estimated to be present within the processing chamber 16, the operating pattern 30 that includes various configurations of activations 34 and deactivations 36 of the front and rear fluid nozzles 50, 54 can vary. As exemplified in FIG. 10, three separate small-load configurations 190 for the front and rear fluid nozzles 50, 54 are presented in an exemplary and non-limiting fashion. The differences in the operating pattern 30 of activations 34 and deactivations 36 can vary depending upon the length of the activation 34 or deactivation 36, the operating pattern 30 of activations 34 and deactivations 36, and the alternating and simultaneous activation 34 of the front and rear fluid nozzles 50, 54. Similarly, as exemplified in FIG. 11, three separate large-load configurations 192 of the steam generating system 10 are presented in an exemplary and non-limiting fashion.

As exemplified in FIGS. 10 and 11, the various activations 34 and deactivations 36 of the front fluid nozzle 50 and rear fluid nozzle 54 tends to be longer in the large-load configurations 192 so that greater amounts of steam 14 can be generated within the processing chamber 16. Additionally, the operating pattern 30 of activations 34 and deactivations 36 of the front and rear fluid nozzles 50, 54 can vary between simultaneous activation, sequential activation, prolonged activation or deactivation, and combinations of these variations between the activations 34 and deactivations 36 of the plurality of fluid nozzles 20.

As exemplified in FIG. 12, the difference between the small-load configurations 190 and large-load configuration 192 for the steam generating system 10 can be in the form of a number of cycles performed in a recurring fashion during a particular drying cycle. As shown in FIG. 12, the small-load configuration 190 is repeated ten times where the large-load configuration 192 is repeated 20 times.

As exemplified in FIGS. 8-12, the estimation of load size using the rear and front temperature probes 142, 144 can change the configuration of the steam cycle so that more steam 14 is generated when larger loads of articles 28 are present. It is also contemplated that the estimation of load size performed by the rear and front temperature probes 142, 144 and the controller 170 can extend the time of the cycle so that the additional activations 34 within a large-load configuration 192 can be performed to completion. Alternatively, where a smaller load of articles 28 is being processed, a particular laundry cycle may be shortened after the requisite number of activations 34 and deactivations 36 of the front and rear fluid nozzles 50, 54 has been performed to completion.

According to various aspects of the device, the rear and front temperature probes 142, 144 can also be utilized for determining a garment type or fabric type of the articles 28 that are being processed within the processing chamber 16. Typically, users of laundry appliances 12 tend to group articles 28 to be processed within particular categories. Such categories can include delicates, whites (typically cotton), darks, sheets, linens and other similar fabric-type categories. Article-type categories can include bulky items, non-clothing items (such as shoes), and others. The user interface 100 for the laundry appliance 12 can be configured to provide a selection of garment type. It is also contemplated that the various sensors can be used to estimate a garment type that is being processed. These estimations can be automatically selected or can be part of a confirmation sequence used when selecting a laundry cycle. The confirmation can be related to the particular fabric type or article 28 being processed. The various steam functions 102 presented herein for large and small loads of articles 28 can also vary depending upon the fabric type. Delicates may require lesser amounts of steam 14 where cottons may require larger amounts of steam 14. These various parameters can be adjusted based upon garment type, load size, selected dryness level and other similar parameters that may be hardwired or programmed within the controller 170 for the appliance 12 or selected by a user, or both.

Figure 13:
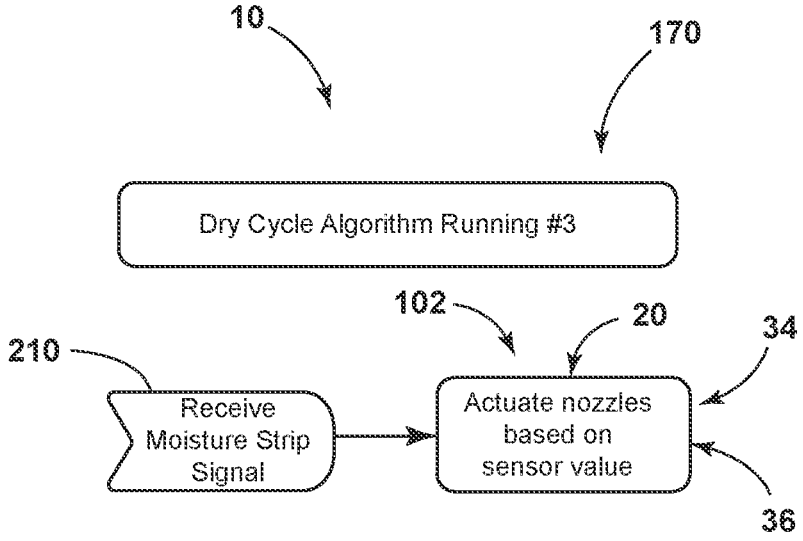
FIG. 13 is a schematic flow diagram illustrating operation of a conductivity sensor for managing an amount of steam generated within the processing chamber.
Figure 14:
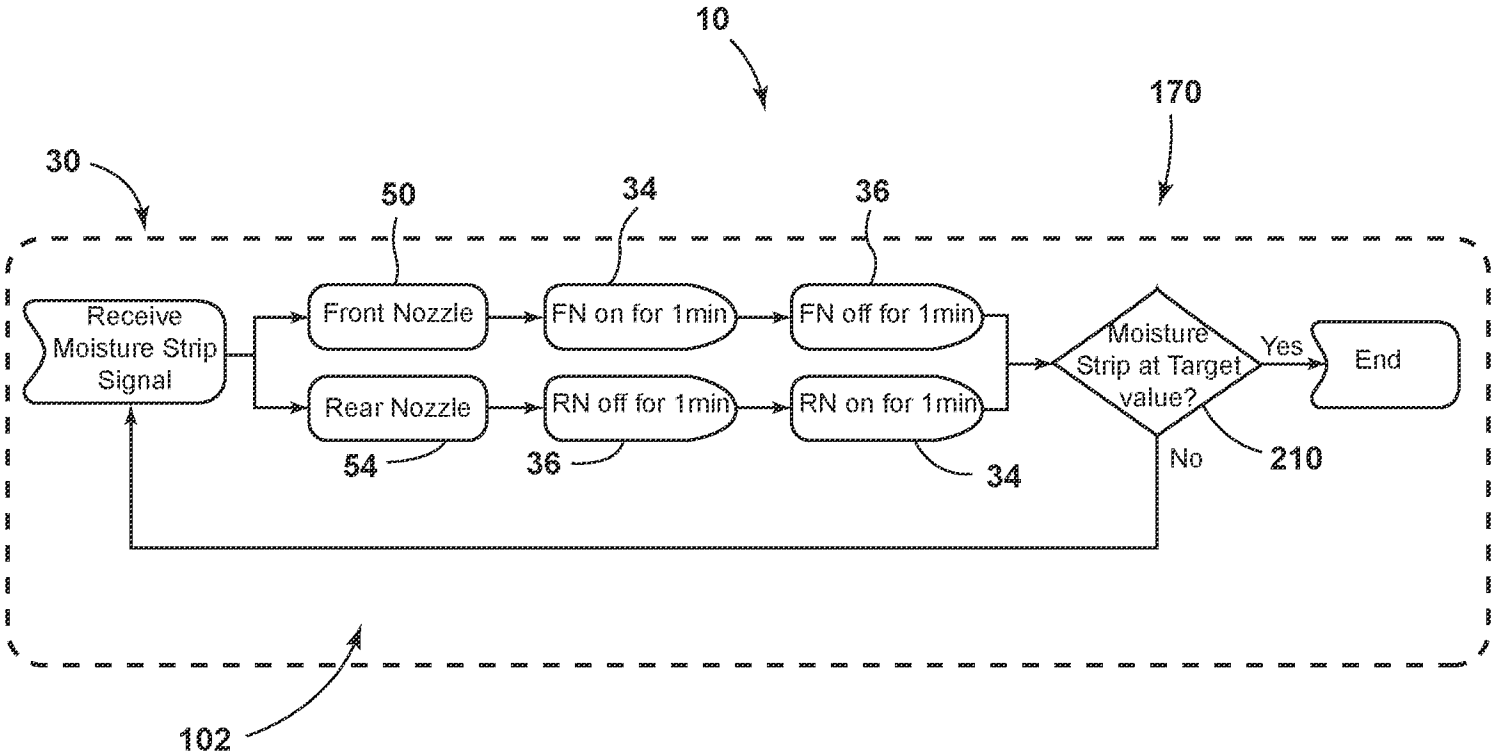
FIG. 14 is a schematic flow diagram illustrating a process of performing a steam function using the plurality of fluid nozzles in using the conductivity strip for assessing the amount of steam generated within the processing chamber.
Figure 15:
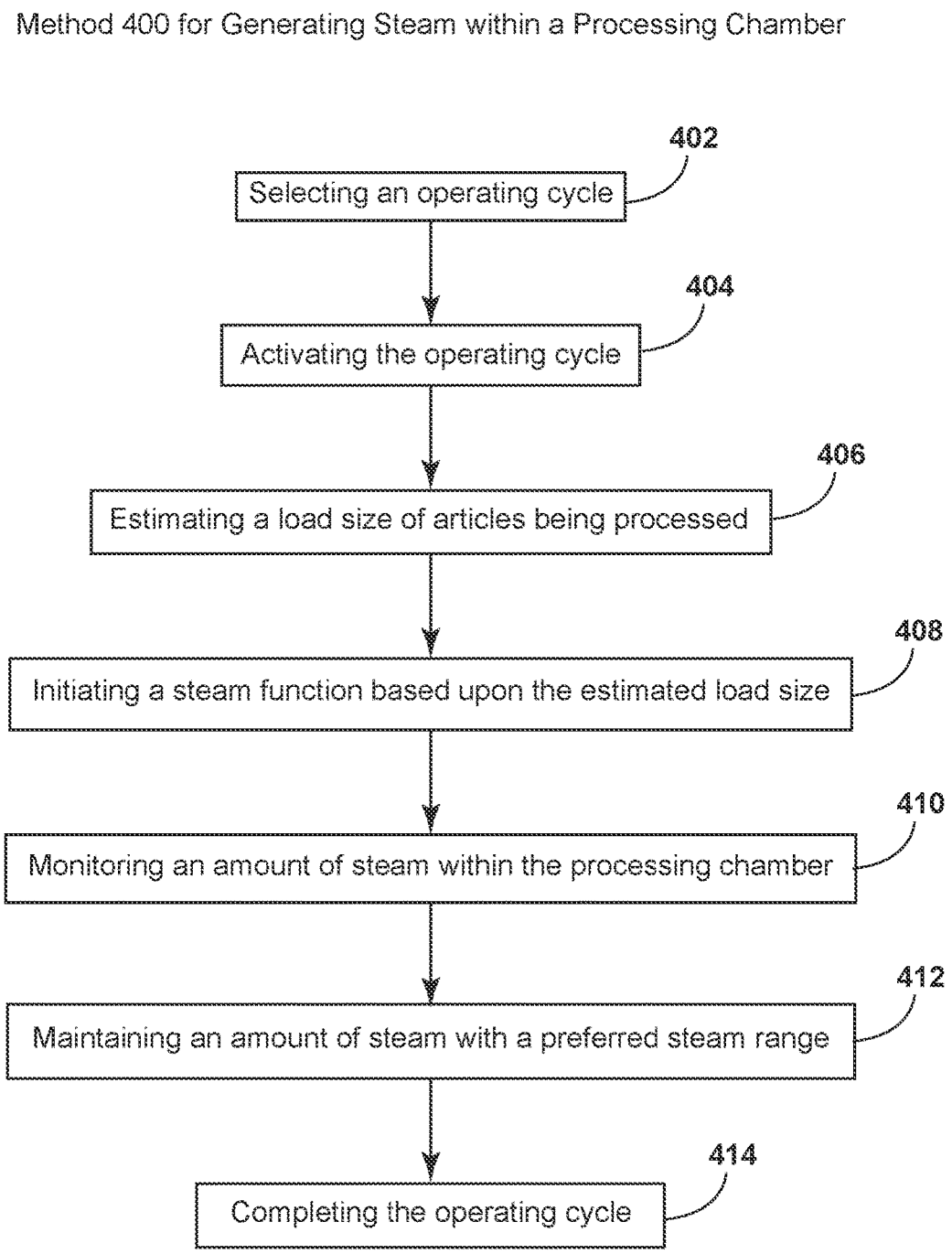
FIG. 15 is a schematic flow diagram illustrating a method for generating steam with a laundry appliance.

Referring now to FIGS. 13 and 14, various mechanisms can be utilized for assessing an amount of steam 14 that has been generated within a laundry appliance 12. By way of example, and not limitation, a conductivity sensor 210, in the form of a conductivity strip, can be positioned within the processing chamber 16. This conductivity sensor 210 can be attached to an inner surface 212 of the drum 18. The amount of humidity within the processing chamber 16, in the form of steam 14, can be sensed by the conductivity sensor 210 for estimating an amount of steam 14 contained within the environment of the processing chamber 16. When an appropriate amount of steam 14 has been achieved within the processing chamber 16, the conductivity sensor 210 senses this amount and communicates with a controller 170 to initiate a deactivation 36 of one or both of the front and rear fluid nozzles 50, 54. The conductivity sensor 210 can also communicate with the controller 170 to modify the activations 34 and deactivations 36 to provide more or less steam 14 within the processing chamber 16.

By way of example, and not limitation, over the course of a drying cycle, the amount of steam 14 required within the processing chamber 16 may change over time. As these steam generating needs change, the conductivity sensor 210 can adjust the activations 34 and deactivations 36 of front and rear fluid nozzles 50, 54 to provide a corresponding increase or decrease in the amount of steam 14 generated therein.

Referring now to FIG. 14, it is contemplated that the conductivity sensor 210 is used to measure a moisture level in relation to a maximum predefined moisture level. Typically, the conductivity sensor 210 is disposed on an inner surface 212 of the drum 18 and measures an amount of moisture or a humidity level of process air 24 within the processing chamber 16. In this manner, when the amount of steam 14 generated within the processing chamber 16 reaches a predefined maximum amount of moisture, the conductivity sensor 210 can communicate with the front and rear fluid nozzles 50, 54, via the controller 170, to initiate a deactivation 36 of the front and rear fluid nozzles 50, 54. If the amount of moisture within the processing chamber 16 dips below the predefined maximum amount or below a predefined minimum amount, the conductivity sensor 210 can measure this decrease in moisture and communicate with the controller 170 to initiate an activation 34 of the front and rear fluid nozzles 50, 54 to provide additional amounts of steam 14, as needed.

Having described various aspects of the steam generating system 10, a method 400 is disclosed for generating steam 14 within a processing chamber 16. The method 400 includes selecting a drying function, steam function 102 or other operating cycle 32 (step 402). As discussed herein, the process of selecting an operating function is typically initiated by a user via a user interface 100. In certain aspects of the device, it is contemplated that a drying appliance 12 can automatically select certain operating cycles 32 based upon various sensor readings of the articles 28 being processed within the drum 18. According to the method 400, the operating cycle 32 is activated (step 404). When activated, a load size of the articles 28 being processed is estimated (step 406). The process of estimating load size can be initiated during the typical performance of a particular operating cycle 32. It is also contemplated that the estimating function can be performed during a dedicated estimation routine that is performed before the selected operating cycle 32 is initiated. Once the load size is estimated, a steam function 102 is initiated based upon the load size (step 408). During performance of the steam function 102 and the operating cycle 32, an amount of steam 14 generated within the processing chamber 16 is monitored (step 410). As discussed herein, this monitoring function is typically performed by a conductivity sensor 210 that is positioned within the processing chamber 16. According to the method 400, an amount of steam 14 is maintained within a preferred steam or moisture range that is below a maximum predetermined amount and above a minimum predetermined amount of moisture (step 412). In this manner, the conductivity sensor 210 communicates with the controller 170 to modify the activations 34 and deactivations 36 of the plurality of fluid nozzles 20 to adjust an amount of steam 14 generated within the processing chamber 16. The operating cycle 32 is then completed (step 414).

According to various aspects of the device, the steam generating system 10 is used to provide an automated steam function 102 that can be adjusted on the fly and in real time during performance of various laundry cycles. The steam generating system 10 generates steam 14 within the processing chamber 16 and provides a desired amount of moisture within the processing chamber 16 for performing various refreshing and dewrinkling type steam functions 102 upon articles 28 contained within the processing chamber 16.

As discussed herein, the steam generating system 10 generates steam 14 within the processing chamber 16 without the aid of a dedicated heating element within the steam generating system 10. It is contemplated that the various algorithms and steam generating cycles discussed herein can be utilized with steam generating systems 10 that do utilize a heating element for generating steam 14 and injecting jets of steam 14 into the processing chamber 16. It is also contemplated that a combination of heated steam generating elements and non-heated fluid nozzles 20 can be used in combination for generating various amounts of steam 14 within the processing chamber 16.

The plurality of fluid nozzles 20 disclosed herein can include the front fluid nozzle 50 and the rear fluid nozzle 54. It is also contemplated that additional fluid nozzles 20 can be incorporated within the drum 18 for providing other configurations of a three-dimensional steam generating function of the steam generating system 10. Where additional fluid nozzles 20 are provided in a steam generating system 10, the configuration of activations 34 and deactivations 36 of the plurality of fluid nozzles 20 can be adjusted to provide the desired amounts of steam 14 and configurations of steam 14 within the processing chamber 16. The configurations of steam 14 provided by the plurality of fluid nozzles 20 are intended to provide steam 14 throughout the processing chamber 16 so that the articles 28 receive steam 14 from below via the rear fluid nozzles 54 and also tumbles through a generated section of steam 14 within an upper portion 52 of the processing chamber 16. This combination of fluid nozzles 20 is configured to provide sufficient steam 14 to allow steam 14 to move within, around and through various articles 28 being processed.

According to another aspect of the present disclosure, a laundry appliance includes a blower that delivers process air through an airflow path. A rotating drum defines a processing chamber. The processing chamber is part of the airflow path. A steam generating system disposes steam into the processing chamber. A plurality of fluid nozzles direct the steam into the processing chamber according to an operating pattern. The plurality of fluid nozzles include a first nozzle that is positioned within an upper portion of the processing chamber and a second nozzle that is positioned in a lower portion of the processing chamber.

According to another aspect, the operating pattern is based upon a fabric type that is being processed in the processing chamber.

According to yet another aspect, the operating pattern is based upon an amount of articles that are being processed in the processing chamber.

According to another aspect of the present disclosure, the operating pattern includes activations and deactivations of the plurality of fluid nozzles.

According to another aspect, the rotating drum operates within the cabinet and includes an access aperture that provides selective access to the processing chamber. The first nozzle is positioned above the access aperture and is oriented to direct a first jet of fluid in a downward direction toward a rear panel of the processing chamber.

According to yet another aspect, the second nozzle is positioned within the rear panel and is oriented to direct a second jet of fluid in an upward direction toward the access aperture.

According to another aspect of the present disclosure, a steam generator generates steam having a temperature that is similar to an air temperature of the process air within the processing chamber. The steam generator delivers fluid to the first nozzle and the second nozzle according to the operating pattern.

According to another aspect, the operating pattern includes selective activation of valves for the first nozzle and the second nozzle, respectively. The steam generator includes the first nozzle and the second nozzle.

According to yet another aspect, a conductivity sensor is in communication with the steam generator and the valves. The conductivity sensor measures a humidity level within the processing chamber. The operating pattern and the selective activation of the valves are operated at least partially according to the humidity level within the processing chamber as measured by the conductivity sensor.

According to another aspect of the present disclosure, a rear temperature probe is positioned within the airflow path and proximate the rear panel of the processing chamber. The rear temperature probe measures an air temperature of the process air entering the processing chamber. A front temperature probe is positioned within the airflow path and proximate a front panel of the processing chamber. The front temperature probe measures the air temperature of the process air exiting the processing chamber. The rear and front temperature probes measure a temperature change of the process air. The operating pattern and the selective activation of the valves are operated at least partially according to the temperature change of the process air.

According to another aspect, a laundry appliance includes a cabinet having an access aperture defined within a front panel of the cabinet. A drum rotates within the cabinet. The access aperture provides selective access to a processing chamber defined within the drum. A steam generating system delivers steam to the processing chamber. A first nozzle is coupled to the front panel and above the access aperture. A second nozzle is positioned within a rear panel of the processing chamber. A steam generator delivers steam to the first nozzle and the second nozzle according to an operating pattern. The operating pattern is determined by a plurality of sensors that are positioned in communication with the processing chamber. The steam generator generates steam in the absence of a dedicated heating element.

According to yet another aspect, the operating pattern includes selective operation of the first and second nozzles.

According to another aspect of the present disclosure, the first nozzle is positioned within an upper portion of the processing chamber and a second nozzle is positioned in a lower portion of the processing chamber. The second nozzle is positioned within the rear panel and is oriented to direct steam in an upward direction toward the access aperture.

According to another aspect, the steam generating system includes a steam generator that generates steam having a temperature that is similar to an air temperature of process air within the processing chamber. The steam generator delivers steam to the first nozzle and the second nozzle according to the operating pattern.

According to yet another aspect, the steam generating system includes valves that are positioned between the steam generator and the first and second nozzles. The operating pattern includes selective activation of the valves for the first nozzle and the second nozzle, respectively.

According to another aspect of the present disclosure, a conductivity sensor is in communication with the steam generator and the valves. The conductivity sensor is disposed on a surface of the drum and measures a humidity level of process air within the processing chamber. The operating pattern and the selective activation of the valves are operated at least partially according to the humidity level, as measured by the conductivity sensor.

According to another aspect, a laundry appliance includes a cabinet having an access aperture. A drum rotates within the cabinet to process a load of articles. The access aperture provides selective access to a processing chamber defined within the drum. A steam generating system delivers steam to the processing chamber. A first nozzle is coupled to a front panel and above the access aperture. A second nozzle is positioned within a rear panel of the processing chamber. The steam generating system delivers steam to the first nozzle and the second nozzle according to an operating pattern. The operating pattern is determined by a plurality of sensors that are positioned in communication with the processing chamber. The first nozzle is oriented to direct a first jet of fluid in a downward direction toward a rear panel of the processing chamber and the second nozzle is positioned within the rear panel and is oriented to direct a second jet of fluid in an upward direction toward the access aperture. The first and second jets of fluid define a three-dimensional pattern of steam that engages the load of articles from above and below, respectively.

According to yet another aspect, the operating pattern is based upon at least one of a fabric type that is being processed in the processing chamber and an amount of articles that are being processed in the processing chamber.

According to another aspect of the present disclosure, the operating pattern includes activations and deactivations of the first nozzle and the second nozzle.

According to another aspect, the plurality of sensors includes a conductivity sensor for measuring a humidity of process air within the processing chamber, a rear temperature probe and a front temperature probe. The rear and front temperature probes measure a temperature difference between the process air entering the processing chamber and the process air leaving the processing chamber. The humidity and the temperature difference cooperate to define the operating pattern.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a cabinet having an access aperture;

a blower that delivers process air through an airflow path;

a rotating drum positioned within the cabinet, the rotating drum defining a processing chamber, wherein the processing chamber is part of the airflow path, wherein the access aperture provides selective access to the processing chamber;

a steam generating system that disposes steam into the processing chamber; and a plurality of fluid nozzles that direct the steam into the processing chamber according to an operating pattern, wherein the plurality of fluid nozzles includes a first nozzle that is positioned within an upper portion of the processing chamber and a second nozzle that is positioned in a lower portion of the processing chamber, wherein the first nozzle is positioned above the access aperture and is oriented to direct a first jet of fluid in a downward direction toward a rear panel of the processing chamber, and wherein the second nozzle is positioned within the rear panel and is oriented to direct a second jet of fluid in an upward direction toward the access aperture.

2. The laundry appliance of claim 1, wherein the operating pattern is based upon a fabric type that is being processed in the processing chamber.

3. The laundry appliance of claim 1, wherein the operating pattern is based upon an amount of articles that are being processed in the processing chamber.

4. The laundry appliance of claim 1, wherein the operating pattern includes activations and deactivations of the plurality of fluid nozzles.

5. The laundry appliance of claim 1, further comprising a steam generator that generates steam having a temperature that is similar to an air temperature of the process air within the processing chamber, and wherein the steam generator delivers fluid to the first nozzle and the second nozzle according to the operating pattern.

6. The laundry appliance of claim 5, wherein the operating pattern includes selective activation of valves for the first nozzle and the second nozzle, respectively, wherein the steam generator includes the first nozzle and the second nozzle.

7. The laundry appliance of claim 6, further comprising:

a conductivity sensor in communication with the steam generator and the valves, wherein the conductivity sensor measures a humidity level within the processing chamber, and wherein the operating pattern and the selective activation of the valves are operated at least partially according to the humidity level within the processing chamber as measured by the conductivity sensor.

8. The laundry appliance of claim 6, further comprising:

a rear temperature probe positioned within the airflow path and proximate the rear panel of the processing chamber, the rear temperature probe measuring an air temperature of the process air entering the processing chamber; and a front temperature probe positioned within the airflow path and proximate a front panel of the processing chamber, the front temperature probe measuring the air temperature of the process air exiting the processing chamber wherein;

the rear and front temperature probes measure a temperature change of the process air; and the operating pattern and the selective activation of the valves are operated at least partially according to the temperature change of the process air.

9. A laundry appliance comprising:

a cabinet having an access aperture defined within a front panel of the cabinet;

a drum that rotates within the cabinet, wherein the access aperture provides selective access to a processing chamber defined within the drum;

a steam generating system that delivers steam to the processing chamber;

a first nozzle that is coupled to the front panel and above the access aperture; and a second nozzle that is positioned within a rear panel of the processing chamber; wherein the first nozzle is positioned within an upper portion of the processing chamber and is oriented to direct a first jet of fluid in a downward direction toward a rear panel of the processing chamber;

the second nozzle is positioned within a lower portion of the processing chamber and is oriented to direct the steam in an upward direction toward the access aperture;

a steam generator delivers steam to the first nozzle and the second nozzle according to an operating pattern, wherein the operating pattern is determined by a plurality of sensors that are positioned in communication with the processing chamber; and the steam generator generates steam in the absence of a dedicated heating element.

10. The laundry appliance of claim 9, wherein the operating pattern includes selective operation of the first and second nozzles.

11. The laundry appliance of claim 9, wherein the steam generating system includes a steam generator that generates steam having a temperature that is similar to an air temperature of process air within the processing chamber, and wherein the steam generator delivers steam to the first nozzle and the second nozzle according to the operating pattern.

12. The laundry appliance of claim 11, wherein the steam generating system includes valves that are positioned between the steam generator and the first and second nozzles, wherein the operating pattern includes selective activation of the valves for the first nozzle and the second nozzle, respectively.

13. The laundry appliance of claim 12, further comprising:

a conductivity sensor in communication with the steam generator and the valves, wherein the conductivity sensor is disposed on a surface of the drum and measures a humidity level of process air within the processing chamber, and wherein the operating pattern and the selective activation of the valves are operated at least partially according to the humidity level, as measured by the conductivity sensor.

14. The laundry appliance of claim 9, wherein the operating pattern is based upon a fabric type that is being processed in the processing chamber.

15. The laundry appliance of claim 9, wherein the operating pattern is based upon an amount of articles that are being processed in the processing chamber.

16. The laundry appliance of claim 9, wherein the operating pattern includes a pattern of selective activations and deactivations of the first nozzle and the second nozzle.

17. A laundry appliance comprising:

a cabinet having an access aperture;

a drum that rotates within the cabinet to process a load of articles, wherein the access aperture provides selective access to a processing chamber defined within the drum;

a steam generating system that delivers steam to the processing chamber;

a first nozzle that is coupled to a front panel and above the access aperture; and a second nozzle that is positioned within a rear panel of the processing chamber; wherein the steam generating system delivers steam to the first nozzle and the second nozzle according to an operating pattern, wherein the operating pattern is determined by a plurality of sensors that are positioned in communication with the processing chamber;

wherein the first nozzle is oriented to direct a first jet of fluid in a downward direction toward a rear panel of the processing chamber and the second nozzle is positioned within the rear panel and is oriented to direct a second jet of fluid in an upward direction toward the access aperture; and wherein the first and second jets of fluid define a three-dimensional pattern of steam that engages the load of articles from above and below, respectively.

18. The laundry appliance of claim 17, wherein the operating pattern is based upon at least one of a fabric type that is being processed in the processing chamber and an amount of articles that are being processed in the processing chamber.

19. The laundry appliance of claim 17, wherein the operating pattern includes activations and deactivations of the first nozzle and the second nozzle.

20. The laundry appliance of claim 17, wherein the plurality of sensors includes a conductivity sensor for measuring a humidity of process air within the processing chamber, a rear temperature probe and a front temperature probe, wherein the rear and front temperature probes measure a temperature difference between the process air entering the processing chamber and the process air leaving the processing chamber, wherein the humidity and the temperature difference cooperate to define the operating pattern.

* * * * *